United States Patent [19]

Ortemond

[11] Patent Number: 4,826,023

[45] Date of Patent: May 2, 1989

[54] CRANE FOR OFFSHORE PLATFORM AND METHOD OF INSTALLING SAME

[76] Inventor: Leon D. Ortemond, Rt. 2, Box 2290, Abbefille, La. 70510

[21] Appl. No.: 753,768

[22] Filed: Jul. 10, 1985

Related U.S. Application Data

[63] Continuation of Ser. No. 621,445, Jun. 18, 1984, abandoned.

[51] Int. Cl.[4] ..... B66C 23/34

[52] U.S. Cl. ..... 212/176; 212/185; 212/192; 212/239; 212/262

[58] Field of Search ..... 212/175, 176, 182, 183, 212/185, 186, 190, 192, 193, 239, 262; 114/91, 187; 414/139, 140

[56] References Cited

U.S. PATENT DOCUMENTS

| | | | |
|---|---|---|---|
| 123,825 | 2/1872 | Hamilton | 114/187 |
| 240,028 | 4/1881 | Joseph | 114/187 |
| 411,214 | 9/1889 | Chapman | 212/193 |
| 1,018,529 | 2/1912 | Swensson | 212/253 |
| 2,051,497 | 8/1936 | Sasgen et al. | 212/177 |
| 2,929,516 | 3/1960 | Fladmark | 212/192 |
| 2,961,102 | 11/1960 | Pitman | 212/238 |
| 3,113,681 | 12/1963 | Crile | 212/228 |
| 3,977,548 | 8/1976 | McCannon et al. | 212/175 |
| 4,144,940 | 3/1979 | Ortemond | 405/195 |
| 4,191,502 | 3/1980 | Komatsu | 212/193 |

*Primary Examiner*—Sherman D. Basinger
*Assistant Examiner*—Stephen P. Avila
*Attorney, Agent, or Firm*—Browning, Bushman, Zamecki & Anderson

[57] ABSTRACT

A crane or derrick for use on an offshore platform comprising a base, a boom operatively connected to the base, and a sectioned kingpole secured to said base, the kingpole including a first kingpole section secured to the base and at least one additional kingpole section removably secured to the first kingpole section. The sectioned kingpole permits the installation of a crane having a tall kingpole and thereby greater lifting capacity such that equipment necessary to carry out operations such as the driving of conductor pipe and piling can be erected on the deck of the platform without the necessity for utilizing a derrick barge.

6 Claims, 2 Drawing Sheets

CRANE FOR OFFSHORE PLATFORM AND METHOD OF INSTALLING SAME

This is a continuation, of application Ser. No. 621,445, filed June 18, 1984, now abandoned.

BACKGROUND OF THE INVENTION

The present invention relates to a crane or derrick, and, more particularly, to a crane or derrick for installation and use on an offshore platform.

In conducting drilling operations from offshore platforms, as is well known to those skilled in the art, it is usually necessary to utilize a derrick barge to load heavy equipment on to the platform deck, the derrick barge usually being provided with a crane or similar lifting apparatus for lifting such equipment. Additionally, as pointed out in U.S. Pat. No. 4,144,940, it is generally necessary to use a derrick barge for driving conductor pipe and piling, preliminary to actual drilling operations, as the offshore platform is not normally provided either with equipment to actually drive pile or conductor pipe, or to install apparatus on the platform, e.g. a pile driving rig, for carrying out those operations. The use of a derrick barge is expensive, particularly if the barge has to remain at the offshore platform location for any period of time. This is generally the case with a new offshore platform which usually is not provided with a crane or other lifting device suitable for raising heavy loads onto the deck of the platform. Moreover, stationing of a derrick barge adjacent an offshore platform can pose a severe safety hazard should turbulent weather be encountered. It would clearly be more economical and safer to have a lifting means on the platform deck which could lift equipment from a less costly supply barge or supply boat to the deck of the platform. It is known to erect lifting devices such as stiff leg cranes on the deck of the platform in order to provide a lifting means to lift equipment and the like from supply boats onto the platform deck. However, such stiff leg cranes, because of their size, do not have the lifting capacity to raise heavy loads to the platform deck.

It will be recognized that in a crane or derrick of the fixed guy or stiff leg type, the higher the kingpole or mast, the larger the lifting capacity of the crane or derrick because of the higher center of gravity However, a kingpole or mast which is tall enough to permit the lifting of heavy loads must also possess sufficient structural integrity so as to resist the compressive and tensile forces acting on the kingpole when the crane is in use. This means that the kingpole is intrinsically heavy as it will generally be made of thick walled pipe or similar, heavy tubular material. Thus, while it would be desirable to have a crane on the platform deck which could lift heavy enough loads to eliminate the need for a derrick barge, the size of such a crane virtually dictates that a derrick barge must be employed to erect such a crane on the platform deck.

SUMMARY OF THE INVENTION

It is therefore an object of the present invention to provide a crane which can be erected on an offshore platform without the need of a derrick barge and which is capable of picking up loads normally handled by a derrick barge.

Another object of the present invention is to provide a crane which can be erected on an offshore platform utilizing components which can be lifted to the platform deck by hand-operated or similarly small lifting apparatus, such as a conventional block and tackle.

Still a further object of the present invention is to provide a method for erecting a crane on an offshore platform.

The above and other objects of the present invention will become apparent from the drawings, the description given herein and the appended claims.

The crane of the present invention comprises a base, a boom operatively secured to the base and a sectioned kingpole, the sections of the kingpole being provided with means to secure them to adjacent sections of the kingpole whereby a large kingpole can be installed from smaller, easier to handle sections.

In another embodiment, the present invention provides a method of erecting a crane on an offshore platform comprising the steps of transporting to the platform deck a crane assembly including a base, a boom for operatively connecting to the base and a kingpole for securing to the base, the kingpole including a first section for securing to the base and a second section for removably securing to the first section; erecting the base on the platform; securing the first section of the kingpole to the base; securing the second section of the kingpole to the first section of the kingpole; operatively connecting the boom to the base; operatively interconnecting the kingpole and the boom with means for raising and lowering the boom relative to the king pole; and providing the boom with load lifting means.

DETAILED DESCRIPTION OF THE PREFERRED EMBODIMENT

Figure 1:
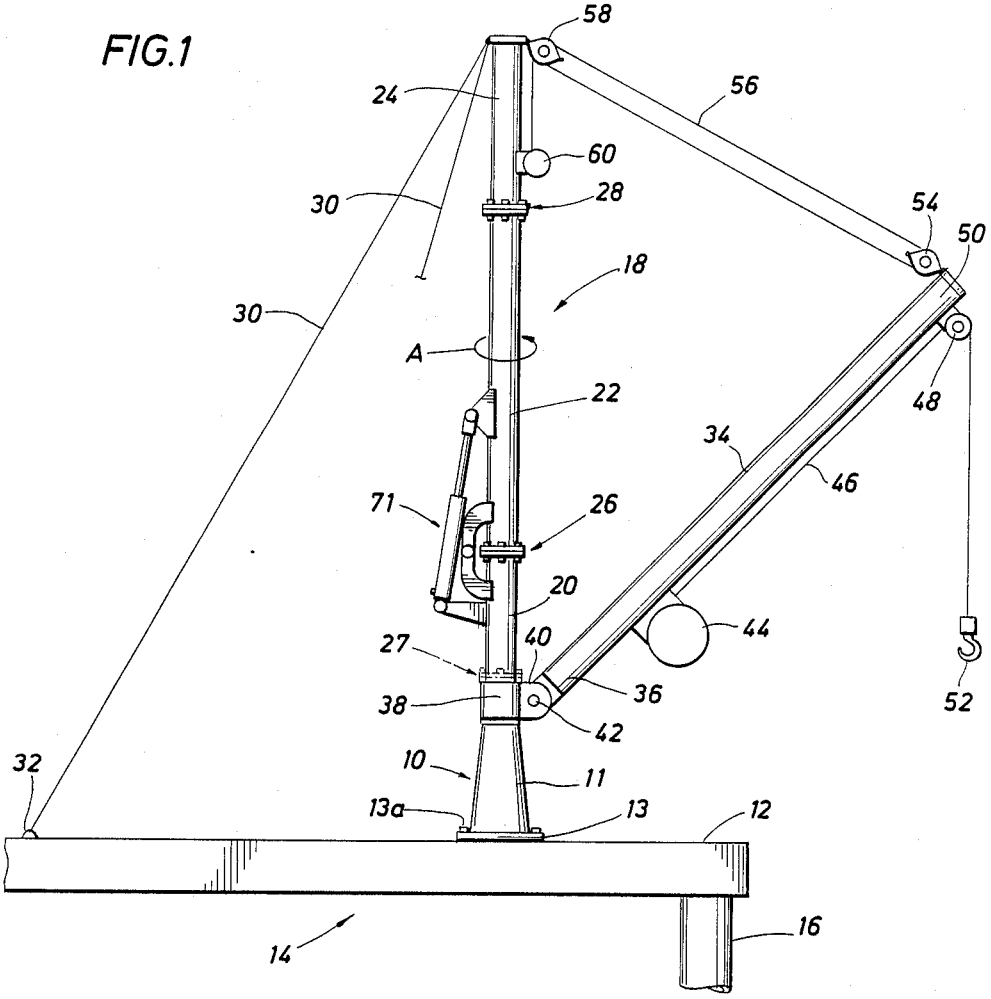
FIG. 1 is an elevational view showing the crane of the present invention, in the fully erected position, on the deck of a typical offshore platform.

Referring first to FIG. 1, the crane or derrick of the present invention is seen to include a base or pedestal shown generally as 10. Base 10 comprises a turret portion 11 which is rotatably mounted on the base support 13 whereby the base 10 can rotate as shown by arrow A in the well known manner to effect rotation of the kingpole or in mast 18. The base 10 is secured by means of bolts 13*a* or in other well known fashion to the deck 12 of an offshore platform indicated generally at 14. As will be appreciated by those skilled in the art, the offshore platform 14, shown only in fragmentary form, will include numerous cross beams, bracing and other structural members as well as generally vertically extending support members or pilings 16 upon which the deck 12 rests and which generally rest on or extend into the ocean floor.

Attached to base 10 is a kingpole or mast shown generally at 18. Kingpole 18 includes a first, lower section 20 which is secured to base 10, a second, intermediate section 22 removably secured to first section 20 and a third, upper section 24 removably secured to second section 22. As will be described more fully below, second section 22 is connected to first and third sections 20 and 24 by means of flange joints 26 and 28, respectively.

It will be appreciated that, depending on the size of the crane, lower or first kingpole section 20 can be fixedly secured to base 10 or can be removably connected by a flange connection, shown in phantom as 27, in the same manner that second kingpole section 22 is connected to first kingpole section 20 and third kingpole section 24.

Guys 30 extend from the uppermost end of third kingpole section 24 and are fastened as at 32 by a suitable method to the deck 12. It will be appreciated that in a normal case, three or more such guys are employed to maintain kingpole 18 in a vertical position.

A boom 34 has a first or lower end 36 which is pivotally or hingedly attached to base 10 by means of a bracket 38 having a clevis 40 and a pivot pin 42 whereby boom 34 can move in a generally vertical plane. Mounted on boom 34 is a conventional winch assembly 44 for taking in or paying out a load lift line 46 which runs through a sheave assembly 48 secured to the second, upper end 50 of boom 34. A grappling hook 52 is suspended from the free end of line 46. Also secured to the upper end 50 of boom 34 is a second sheave assembly 54. A boom lift line 56 runs between sheave assembly 54 and a sheave assembly 58 attached to the upper end of third kingpole section 24. Boom lift line 56 is attached to a conventional winch assembly 60 which pays out or takes in line 56 thereby resulting in lowering or raising of boom 34.

Figure 2:
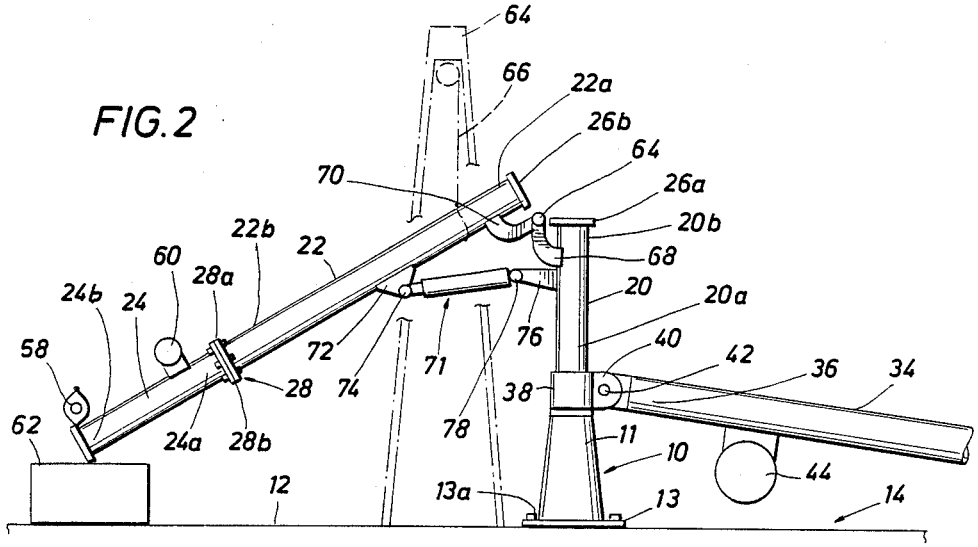
FIG. 2 is an elevational view showing the crane of FIG. 1 in a partially pre-assembled condition.

Referring now to FIG. 2, the crane or derrick of the present invention is shown in a partly assembled or erected condition. To this end, the components of the crane such as base assembly 10, sections of kingpole 18, boom 34, which can also be in sections, and the various winches, sheaves and lines and attendant equipment, would be transported to the platform site, e.g. by supply boat or barge, and placed on deck 12 by means of a helicopter, which could also be used for transport purposes, by hand, by using a block and tackle, or by any other suitable method by which the components could be placed on deck 12 for assembly. Base support 13 with rotatably mounted turret 11 is then secured to deck 12 by any suitable method, such as by bolts 13*a*. Boom 34 can then be connected to lower kingpole section 20 and hence operatively connected to base 10 using bracket 38 and pivot pin 42. In the position shown in FIG. 2, boom 34 would have its upper or second end 50 resting on deck 12.

First kingpole section 20 has a first end 20*a* secured to base assembly 10 and a second end 20*b* provided with flange 26*a*. Second kingpole section 22 has a first end 22*a* provided with a flange 26*b*. Third kingpole section 24 has a first end 24*a* provided with a flange 28*b*, flanges 28*a* and 28*b* being secured together as shown so as to axially align and connect together third kingpole section 24 and second kingpole section 22. Third kingpole section 24 also has a second end 24*b* which, as shown, rests on a temporary support 62. In the usual case, kingpole sections 22 and 24 would first be connected together and could then be raised to the position shown in FIG. 2 by means of an A-frame hoist 64 and a hoist line 66 secured generally to first 22*a* of kingpole section 22 such that end 22*a* can be positioned adjacent end 20*b* of kingpole section 20 as shown. To interconnect kingpole section 20 and kingpole section 22, a hinge pin 64 is inserted into registering holes (not shown) in first and second hinge arms 68 and 70 secured to first and second kingpole sections 20 and 22, respectively. It will now be appreciated that connected kingpole sections 22 and 24 can now be jointly, pivotally moved about hinge pin 64 and be brought in substantially axial alignment with kingpole section 20 whereby flanges 26*a* and 26*b* will be in abutment with another. To this end, a lifting means comprised of a hydraulic or pneumatic piston-cylinder combination 71 is interconnected by a bracket 72 and a pivot pin 74 to kingpole section 22 and by bracket 76 and a pivot pin 78 to kingpole section 20. Hydraulic or pneumatic power can be supplied to piston cylinder assembly 71 in the well known manner.

Figure 3:
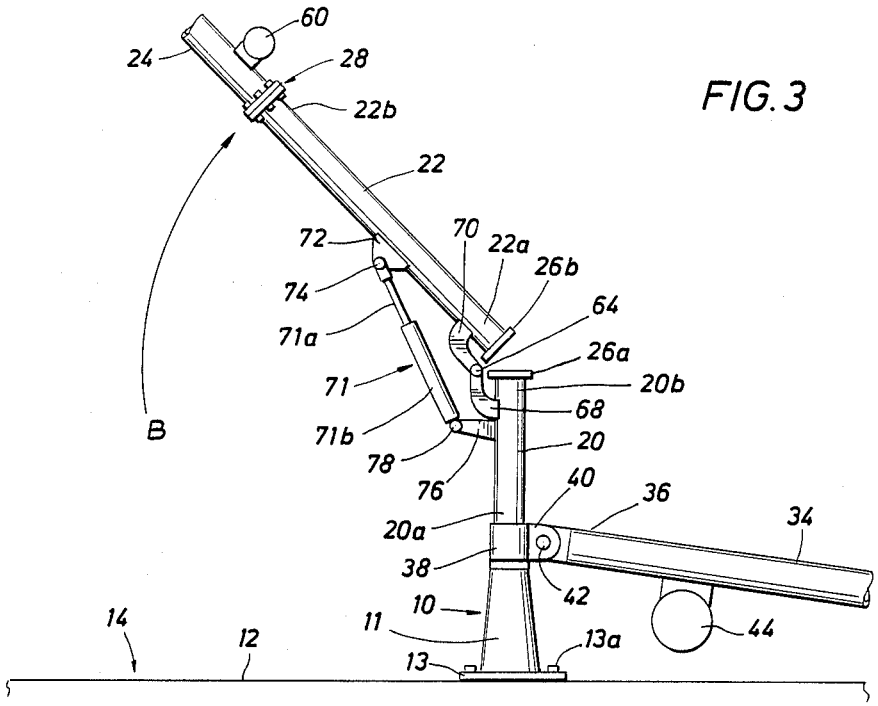
FIG. 3 is an elevational view similar to FIG. 2 showing the crane in a later stage of erection.

Referring now to FIG. 3, upon the application of hydraulic or pneumatic power to piston-cylinder assembly 70, piston rod 70*a* will be forced out of cylinder 70*b* whereupon connected kingpole sections 22 and 24 will be moved in the direction of arrow B, i.e. in a generally vertical plane. Continued application of hydraulic or pneumatic power to piston cylinder assembly 70 will bring connected kingpole sections 22 and 24 into the position shown in FIG. 4, i.e. axially aligned with kingpole section 20 and with flanges 26*a* and 26*b* in abutting relationship. Flanges 26*b* and 26*a* can then be secured together by flange bolts to form flange joint 26.

Figure 4:
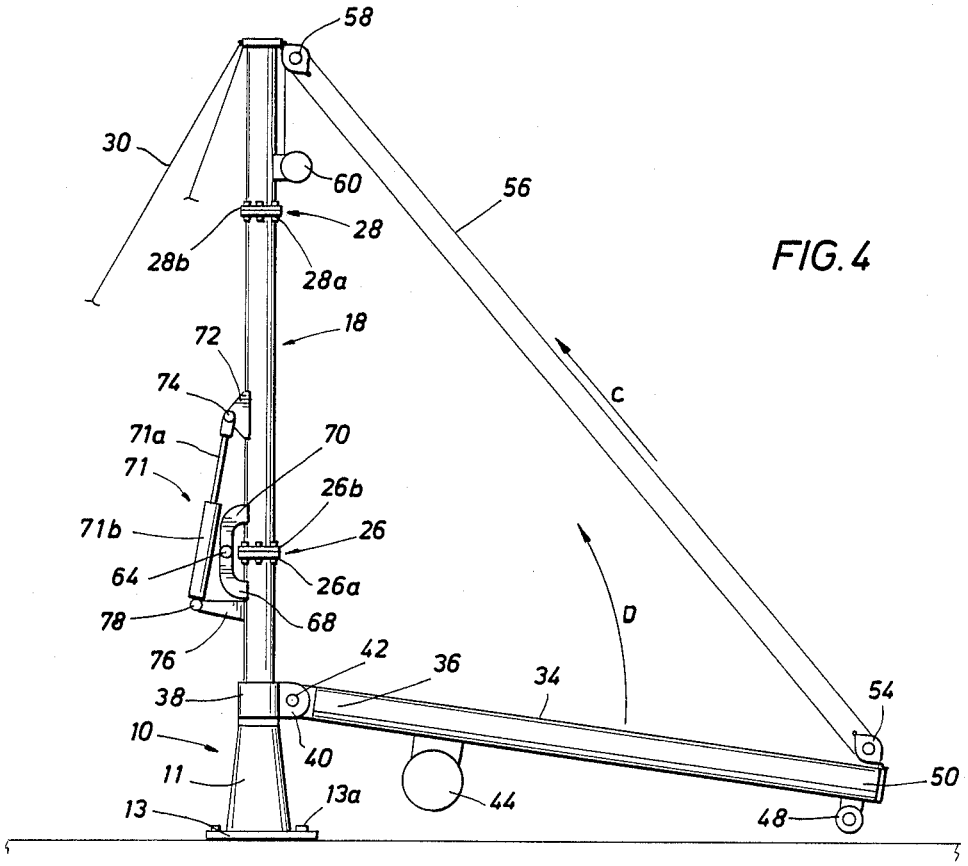
FIG. 4 is a view similar to FIG. 1 showing the crane with the boom in a lowered position and prior to attachment of the load lifting and boom lines.

Once kingpole 18 has been fully erected as shown in FIG. 4, it can be secured with guys 30 to the deck 12 of platform 14. Boom lift line 66 can then be attached to kingpole 18 and boom 34 by means of sheaves 58 and 54, respectively. Winch 60 can then be activated so as to take in boom lift line 56 in the direction shown in arrow C resulting in an upward movement of boom 34 in the direction shown by arrow D. Load lift line 46 can then be secured to boom 34 and winch 44 in the manner shown in FIG. 1 to complete erection of the crane. The crane is then ready to be used to lift equipment and/or supplies from a supply boat or barge onto the deck 12 of platform 14.

It will be appreciated that the present invention permits the installation of a larger kingpole resulting in a crane of larger lifting capacity. Indeed, the crane of the present invention can be utilized to load onto the deck of the platform components of larger cranes or pile driving rigs which can then be used to drive conductor pipe or for numerous other operations normally carried on on offshore platforms. The present invention thus provide a means whereby heavy equipment can be moved onto the deck of an offshore platform and operations such as driving conductor pipe can be carried on without the necessity of a derrick barge stationed adjacent the platform. The crane of the present invention can be used, without the assistance of a derrick barge, to hoist the drill rig onto the platform and to pick up deck sections and place them on the legs of the offshore platform. It has been common prior art practice to use the drill rig to pick up deck sections. Using the crane of the present invention, the need for transporting the drill rig to the platform site is eliminated until it is time to commence the actual drilling operation.

While in the method described above, the boom is attached prior to the kingpole, it will be recognized that the kingpole could first be erected, and in many cases this is preferable, following which the boom can then be attached.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. A crane apparatus comprising:

a base having a turret portion rotatably mounted on a fixed support;

a boom operatively connected to said turret portion of said base;

a kingpole secured to said turret portion of said base, said kingpole including a first kingpole section having a first end secured to said base and a second end, and a second kingpole section having a first end and a second end, said second end of said first kingpole section and said first end of said second kingpole section being interconnected by pivot means whereby said second kingpole section can be moved between a first position wherein said first and second kingpole sections are generally non-axially positioned with respect to one another and a second position whereby said first and second kingpole sections are generally axially aligned with one another, said first and second kingpole sections being removably secured to one another, and lifting means interconnected between said first and second kingpole sections for moving said second section between said first and second positions.

2. The apparatus of claim 1 wherein said lifting means comprises a hydraulic piston-cylinder arrangement.

3. The apparatus of claim 1 wherein said first and second kingpole sections are connected by a flange joint.

4. The apparatus of claim 1 further including a third kingpole section having a first end connected to said second end of said second kingpole section.

5. The apparatus of claim 4 wherein said second and third kingpole sections are connected by a flange joint.

6. The apparatus of claim 1 wherein said kingpole sections are generally tubular.

* * * * *